US008052503B1

(12) United States Patent
Johnston

(10) Patent No.: US 8,052,503 B1
(45) Date of Patent: Nov. 8, 2011

(54) TOY WHEELED VEHICLE INCLUDING LAUNCHING SYSTEM

(76) Inventor: Andrew L. Johnston, Redwood City, CA (US)

( * ) Notice: Subject to any disclaimer, the term of this patent is extended or adjusted under 35 U.S.C. 154(b) by 236 days.

(21) Appl. No.: 12/509,466

(22) Filed: Jul. 25, 2009

Related U.S. Application Data

(60) Provisional application No. 61/083,711, filed on Jul. 25, 2008.

(51) Int. Cl.
*A63H 17/39* (2006.01)

(52) U.S. Cl. ..... 446/435; 446/470

(58) Field of Classification Search ..... 446/435, 446/470

See application file for complete search history.

(56) References Cited

U.S. PATENT DOCUMENTS 5,906,528 A * 5/1999 Ostendorff et al. ..... 446/6
6,805,609 B1 * 10/2004 Paukert et al. ..... 446/429
7,950,977 B2 * 5/2011 Sun et al. ..... 446/435

* cited by examiner

*Primary Examiner* — Gene Kim
*Assistant Examiner* — Michael Dennis
(74) *Attorney, Agent, or Firm* — Patent Law Offices of Michael E. Woods; Michael E. Woods

(57) ABSTRACT

An amusement system and method for a new toy vehicle that provides speed and unexpected actions, at least in the context of the toy vehicle paradigm. An apparatus includes a wheeled toy vehicle having a motive system coupled to a chassis wherein the chassis includes a bottom surface nearest a rolling surface over which the motive system moves the chassis; and a launching system disposed in an aperture defined in the bottom surface, the launching system including an ejecting system, coupled to the chassis and to the motive system, for holding a ramp within the aperture and for dispensing the ramp between the bottom surface and the rolling surface while the motive system moves the chassis; wherein the ramp launches the chassis above the rolling surface when the motive system moves the chassis onto and over the ramp after the ramp is dispensed from the aperture.

4 Claims, 1 Drawing Sheet

TOY WHEELED VEHICLE INCLUDING LAUNCHING SYSTEM

BACKGROUND OF THE INVENTION

This patent application relates generally to toy vehicles and more specifically to a toy vehicle that includes an integrated launching system.

Amusement devices, like toys, are popular with children and young adults. A particular category of toy that is popular is the toy vehicle. There have been many different variations of these toys well-known in the prior art. Toy manufacturers are always looking for novel features included with these toys. Desirable features include speed and unexpected actions that can thrill these users.

What is needed is a new toy vehicle design and method that provides speed and unexpected actions, at least in the context of the toy vehicle paradigm.

BRIEF SUMMARY OF THE INVENTION

Disclosed is an amusement system and method for a new toy vehicle that provides speed and unexpected actions, at least in the context of the toy vehicle paradigm. An apparatus includes a wheeled toy vehicle having a motive system coupled to a chassis wherein the chassis includes a bottom surface nearest a rolling surface over which the motive system moves the chassis; and a launching system disposed in an aperture defined in the bottom surface, the launching system including an ejecting system, coupled to the chassis and to the motive system, for holding a ramp within the aperture and for dispensing the ramp between the bottom surface and the rolling surface while the motive system moves the chassis; wherein the ramp launches the chassis above the rolling surface when the motive system moves the chassis onto and over the ramp after the ramp is dispensed from the aperture.

The method includes (a) loading a ramp into an ejecting system disposed in an aperture defined in an underside of the toy vehicle; (b) latching the ramp into the ejecting system; (c) powering a motive system of the toy vehicle which drives the toy vehicle forward over a rolling surface; and (d) ejecting the ramp from the ejecting system upon an occurrence of release event while the motive system moves the toy vehicle over the rolling surface, the ejecting step disposing the ramp on the rolling surface and between the rolling surface and the toy vehicle to launch the toy vehicle completely off of the rolling surface from the ramp.

DETAILED DESCRIPTION OF THE INVENTION

Figure 1:
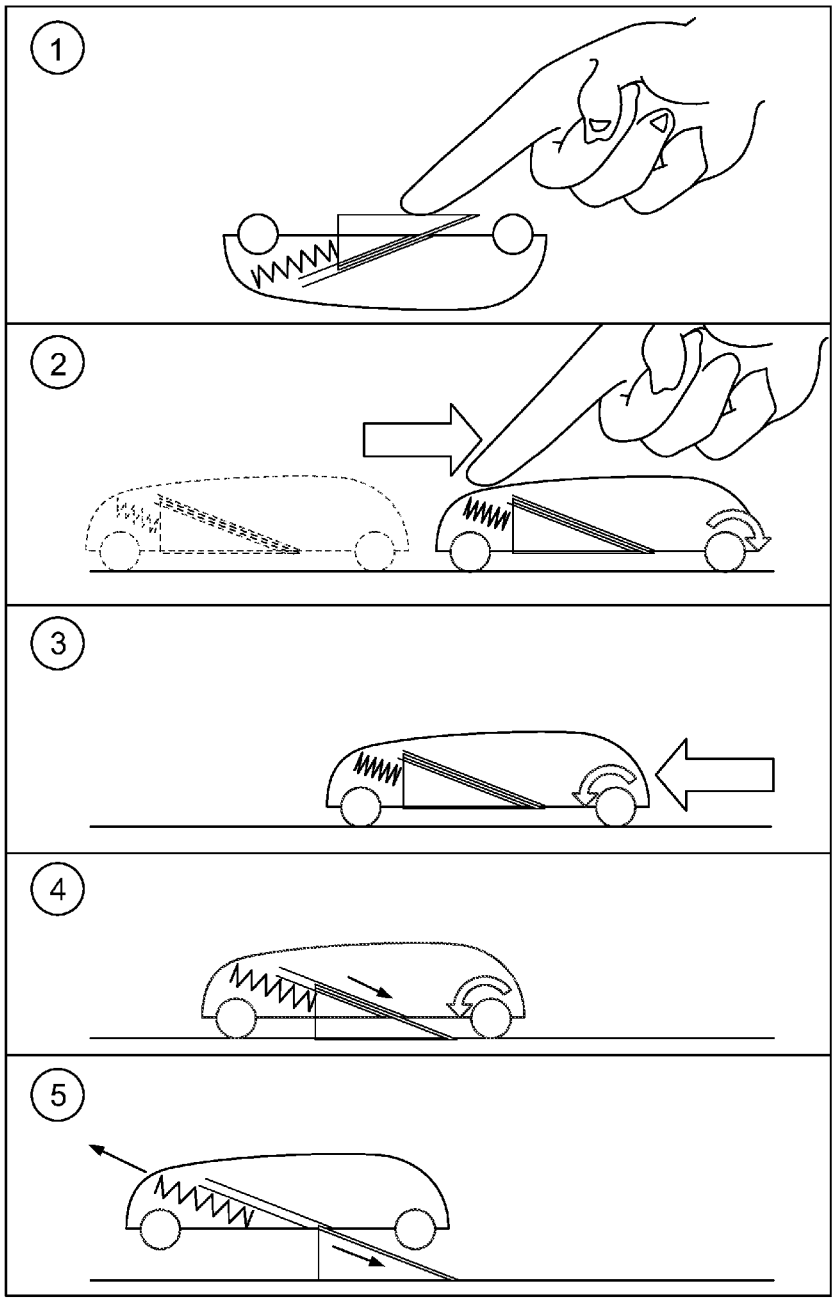
FIG. 1 is a sequenced diagrammatic view of the system and method of the present invention.

The present invention provides an apparatus and method for an interactive toy vehicle that provides new structures and combinations of features for enhancing education and amusement, particularly an improved small-scale vehicle toy that produces an unanticipated action (e.g., it jumps up into the air). The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

FIG. 1 is a sequenced diagrammatic view of the system and method of the present invention for an amusement system (shown as a toy vehicle). FIG. 1 includes five descriptive panels: panel 1 illustrates loading a ramp into an aperture defined by an undersurface of a chassis of the toy vehicle (Load ramp on underside of vehicle, against spring; until it latches into place). The ramp is inserted into a launching system that includes a latching system to retain the ramp within the aperture (and provide suitable clearance so that the ramp does not engage a rolling surface during typical car operation) and includes an ejecting system that springingly ejects the ramp upon occurrence of a release event as further described below. For the purposes of the present description, rolling surface simply refers to the surface over which the vehicle moves. No special surface is required and may be, dependent upon the motive system and scale and other factors apparent to a person of ordinary skill in the art, a floor, tabletop, or other surface made of cement, wood, glass, synthetic materials and the like. The ramp may be completely loaded into the aperture and hidden from view until release. However, other embodiments provide for a portion of the ramp to be visible or exposed while retained in the launching system. In some implementations, the visible portions of the ramp may resemble ornamental features of the vehicle to enhance the vehicle visual elements while the ramp is loaded. There are many advantage to the visible elements, but in one context for small scale vehicles (e.g., 1:64 scale), the phalanges (the elements extending outside the chassis and typically on the sides to represent flames or the like) enable the ramp to be larger and pass safety choke standards for smaller children.

Panel 2 of FIG. 1 illustrates loading a motive system of the toy vehicle (pull back car to load up spring motor). The motive system of this embodiment includes a spring motor coupled to one or more rear wheels. The operator rolls the toy vehicle backwards over the rolling surface which loads the spring motor.

Panel 3 of FIG. 1 illustrates release of the toy vehicle on the rolling surface (release car). Releasing the toy vehicle causes the motive system to drive the toy vehicle forward over the rolling surface. In this mode, the toy vehicle is racing over the rolling surface in a fairly conventional manner, except that the toy vehicle has been loaded with the ramp and is waiting for a release event.

Panel 4 of FIG. 1 illustrates some initial consequences of the release event (after a few feet, the ramp is released and shoots out the bottom of the car; this timing could be achieved with a cam-actuated ramp latch, with the cam tied to the spring motor, producing a repeatable event). Upon occurrence of the release event, the ramp is released and ejected by the ejecting system (e.g., a spring-loaded ejector). The release event may be achieved in many different ways, including a cam-actuated ramp latch coupled to the ejecting system. The cam is coupled to the spring motor so that the release event may be repeatable. For example, release events may include, among other events, release after a certain distance or release after a time of run.

Panel 5 of FIG. 1 illustrates some subsequent consequences of the release event following the initial consequences (car jumps off ramp as ramp is wedged between car and floor; ramp actually doesn't move relative to floor as it is dispensed from car). As the motive system is moving the car forward and the release event has ejected the ramp between the underside of the toy vehicle and the rolling surface, the motive system then drives the toy vehicle up and over the ejected ramp. When the motive system is driving the toy vehicle fast enough and when the toy vehicle weighs less enough, the toy vehicle will be launched into the air by being driven over the ramp. This self-contained "jumping" effect achieves a toy vehicle behavior that is not available in such simple mechanisms and provides additional and enhanced play options for users of this toy vehicle.

After the ramp is deployed and the car is moving forward over (and upward off) the ramp, the bottom chassis is basically sliding up the ramp carried forward by the forward momentum of the car (and the wheels generally are not, and do have to but may depending upon how the ramp is configured, actually touching the ramp at any point). Additionally, the ramp has a weighted bottom plate on it to give it ballast when its deployed and hits the floor. This keeps it stabilized at the moment of the jump as the car is racing over it. Also the effect of this on the car is that when it loses this weighted ramp it actually picks up speed as it has now in essence deployed its cargo bay. Being lighter it is able to accelerate and help give it more speed to be launched over the ramp.

Various components and subsystems of the toy vehicle have been described specifically for automotive toy vehicles, the preferred embodiment is not limited to these types of vehicles or necessarily to vehicles at all. Terms specific to the motive system have been used. While these are descriptive of the preferred embodiments, these terms are not to be understood as limiting the nature of the present invention.

In the description herein, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures may also be implemented in a more separated or integrated manner, or even removed or rendered as inoperable in certain cases, as is useful in accordance with a particular application. It is also within the spirit and scope of the present invention to implement a program or code that may be stored in a machine-readable medium or transmitted using a carrier wave to permit a computer to perform any of the methods described above.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims.

The above-described arrangements of apparatus and methods are merely illustrative of applications of the principles of this invention and many other embodiments and modifications may be made without departing from the spirit and scope of the invention as defined in the claims.

These and other novel aspects of the present invention will be apparent to those of ordinary skill in the art upon review of the drawings and the remaining portions of the specification. Thus, the scope of the invention is to be determined solely by the appended claims.

What is claimed as new and desired to be protected by Letters Patent of the United States is:

1. An apparatus, comprising:

a wheeled toy vehicle having a motive system coupled to a chassis wherein said chassis includes a bottom surface nearest a rolling surface over which said motive system moves said chassis; and a launching system disposed in an aperture defined in said bottom surface, said launching system including an ejecting system, coupled to said chassis and to said motive system, for holding a ramp within said aperture and for dispensing said ramp between said bottom surface and said rolling surface while said motive system moves said chassis;

wherein said ramp launches said chassis above said rolling surface when said motive system moves said chassis onto and over said ramp after said ramp is dispensed from said aperture;

wherein said launching system includes a spring-biased ejector including a latch, said latch dispensing said ramp when said latch is released;

wherein said latch is released responsive to operation of said motive system;

wherein said motive system includes a cam-actuated latch with said motive system releasing said latch upon occurrence of a release event;

wherein said release event includes a travel time from vehicle start.

2. The apparatus of claim 1 wherein said release event includes a travel distance from vehicle start.

3. An apparatus, comprising:

a wheeled toy vehicle having a motive system coupled to a chassis wherein said chassis includes a bottom surface nearest a rolling surface over which said motive system moves said chassis; and a launching system disposed in an aperture defined in said bottom surface, said launching system including an ejecting system, coupled to said chassis and to said motive system, for holding a ramp within said aperture and for dispensing said ramp between said bottom surface and said rolling surface while said motive system moves said chassis;

wherein said ramp launches said chassis above said rolling surface when said motive system moves said chassis onto and over said ramp after said ramp is dispensed from said aperture;

wherein said motive system includes at least a pair of rotatable wheels and a motor coupled to at least one of said wheels for rotating said at least one wheel to move said chassis in a forward direction;

wherein said launching system includes a spring-biased ejector including a latch, said latch dispensing said ramp when said latch is released;

wherein said latch is released responsive to operation of said motive system;

wherein said motive system includes a cam-actuated latch with said motive system releasing said latch upon occurrence of a release event;

wherein said release event includes a travel time from vehicle start.

4. The apparatus of claim 3 wherein said release event includes a travel distance from vehicle start.

* * * * *